US009028093B2

(12) United States Patent
Fabbri

(10) Patent No.: US 9,028,093 B2
(45) Date of Patent: May 12, 2015

(54) RETRO-FIT LUMINAIRE ASSEMBLY

(75) Inventor: William C. Fabbri, Barnstead, NH (US)

(73) Assignee: Koninklijke Philips N.V., Eindhoven (NL)

( * ) Notice: Subject to any disclaimer, the term of this patent is extended or adjusted under 35 U.S.C. 154(b) by 953 days.

(21) Appl. No.: 12/636,864

(22) Filed: Dec. 14, 2009

(65) Prior Publication Data

US 2011/0141743 A1 Jun. 16, 2011

(51) Int. Cl.
*F21S 4/00* (2006.01)
*F21V 23/02* (2006.01)
*F21V 23/00* (2006.01)

(52) U.S. Cl.
CPC ..... *F21V 23/00* (2013.01)

(58) Field of Classification Search
USPC ..... 362/296.01, 355, 222, 220, 221, 364, 362/219
See application file for complete search history.

(56) References Cited

U.S. PATENT DOCUMENTS 8,153,894 B2 * 4/2012 Lydecker et al. ..... 174/58
2007/0211457 A1 * 9/2007 Mayfield et al. ..... 362/223

* cited by examiner

*Primary Examiner* — Anh Mai
*Assistant Examiner* — Jessica M Apenteng

(57) ABSTRACT

A method of retro-fitting an existing luminaire housing comprises the steps of removing lighting components from the existing housing, fastening a first powertray retaining assembly to an end cap of the existing housing, fastening a second powertray retaining assembly to a second end cap of the existing troffer, telescoping a powertray to a size allowing the powertray to be moved through an opening in the existing housing, inserting the powertray through the opening in the existing housing and retaining the powertray on one of the first and second retaining assemblies, telescoping the powertray to engage the other of the first and second retaining assemblies and, positioning a diffuser in the troffer. A retro-fit luminaire assembly is also disclosed.

10 Claims, 10 Drawing Sheets

RETRO-FIT LUMINAIRE ASSEMBLY

TECHNICAL FIELD

This invention pertains to troffer luminaires. More specifically, the invention pertains to troffer luminaries utilizing retro-fit components which provide improved optical performance.

BACKGROUND

In certain circumstances during renovation of buildings, labor intensive replacement of light fixtures may be limited due to budgetary constraints, while these buildings may have pre-existing luminaire fixtures or housings, typical renovations provide for removal of the existing lighting and electrical components, as well as removal of fixture housing structures within the building. Removal of the housing requires access above the ceiling level of the building which may be limited due to the type of ceiling installed, and especially if the ceiling is not being replaced.

Complete replacement of lighting fixtures and the components therein is quite costly in a renovation budget. Additionally, this labor intensive activity also results in high costs for removal and placement of the fixtures.

In order to limit the costs for lighting in renovation projects, it would be highly desirable to utilize certain components or elements of existing lighting with retro-fit components in order to improve optical characteristics and reduce energy consumption of the lights as well as provide a new look for the renovation.

It would also be highly desirable to provide such retro-fit of an existing luminaire at a cost which is less than that of a new lighting installation, both with respect to the equipment and the labor costs associated therewith.

When utilizing a pre-existing housing, one issue to overcome is the length between lamp sockets in relation to the length of an opening in the ceiling. Typically, when fluorescent tube lamps are utilized, the length between opposed lamp sockets may be greater than a dimensional opening of a suspended grid ceiling. As a result, it would be highly desirable to overcome this issue in providing a solution for this and the above deficiencies.

SUMMARY

A method of retro-fitting an existing luminaire housing comprises the steps of removing lighting components from the existing housing, fastening a first powertray retaining assembly to an end cap of the existing housing, fastening a second powertray retaining assembly to a second end cap of the existing troffer, telescoping a powertray to a size allowing the powertray to be moved through an opening in the existing housing, inserting the powertray through the opening in the existing housing and retaining the powertray on one of the first and second retaining assemblies, telescoping the powertray to engage the other of the first and second retaining assemblies and, positioning a diffuser in the troffer. The method further comprises connecting a power supply wire to a ballast. The method further comprises tightening of at least one fastener to lock the powertray at an appropriate length once the powertray is engaging the first and second retaining assemblies. The method further comprises installing a lamp in lamp sockets on the powertray.

A method of retro-fitting an existing luminaire housing, comprises the steps of removing lighting components from an existing housing, connecting a first powertray retaining assembly to the existing housing, connecting a second powertray retaining assembly to the existing housing, opposite the first powertray retaining assembly, inserting a powertray into the existing housing, extending the powertray to a length greater than a distance between support fingers of the first and second powertray retaining assemblies, and, mounting a diffuser in the luminaire housing. The method further comprises tightening a fastener to maintain the powertray in an extended position. The method further comprises engaging the diffuser with a spring located on the first and second powertray retaining assemblies. The method further comprises pivoting the diffuser from a first position to a second position.

A method of installing retro-fit components in a pre-existing housing comprises positioning a powertray within the pre-existing housing, expanding the powertray within the pre-existing housing from a first length to a second length, and, positioning a diffuser within the pre-existing housing. The method further comprises the step of hanging the powertray from a powertray support assembly and connecting a power supply wire to one of a ballast or transformer.

A retro-fit system for a pre-existing troffer luminaire, comprises a pre-existing luminaire housing, a powertray having a reflective surface on at least a lower side, a ballast on an upper side of said powertray and a plurality of lamp sockets positioned near ends of the powertray, the ballast in electronic communication with the lamp sockets, at least one powertray retaining assembly disposed near an end of said housing, said powertray retaining assembly supporting said powertray, the powertray having a first portion and a second telescoping portion to adjust a length of at least one dimension of the powertray. The retro-fit system further comprises a diffuser positioned in a lower opening of the pre-existing luminaire housing. The retro-fit system wherein the diffuser is pivotable between a first upward position and a second downward position. The retro-fit system further comprises a release mechanism for downwardly pivoting the diffuser. The retro-fit system further comprises a diffuser support spring extending from the powertray retaining assembly. The retro-fit system wherein the diffuser is a lens.

A retro-fit system for a pre-existing luminaire troffer, comprises a light diffuser moveable between a first position and a second position allowing access to an interior of said troffer, a powertray retaining assembly connected to said light diffuser and a pre-existing luminaire housing, said powertray having a ballast and at least one lamp socket electrically connected to the ballast, the ballast disposed on an upper side of the powertray, a lower side of the powertray being reflective, the powertray retaining assembly comprising at least one finger which supports a powertray, the powertray having a first portion and an extendable second portion which allows length adjustment of the powertray. The retro-fit system wherein said powertray retaining assembly has a base and at least one support arm extending from the base. The retro-fit system wherein the at least one arm being two support arms. The retro-fit system further comprises a finger extending from the at least one arm. The retro-fit system wherein the retro-fit system has at least one release mechanism. The retro-fit system wherein the powertray retaining assembly has a first spring supporting said powertray. The retro-fit system wherein the light diffuser has a pivot mechanism extending from the diffuser and through the retaining assembly.

BRIEF DESCRIPTION OF THE ILLUSTRATIONS

Embodiments of the invention are illustrated in the following illustrations.

DETAILED DESCRIPTION

Figure 1:
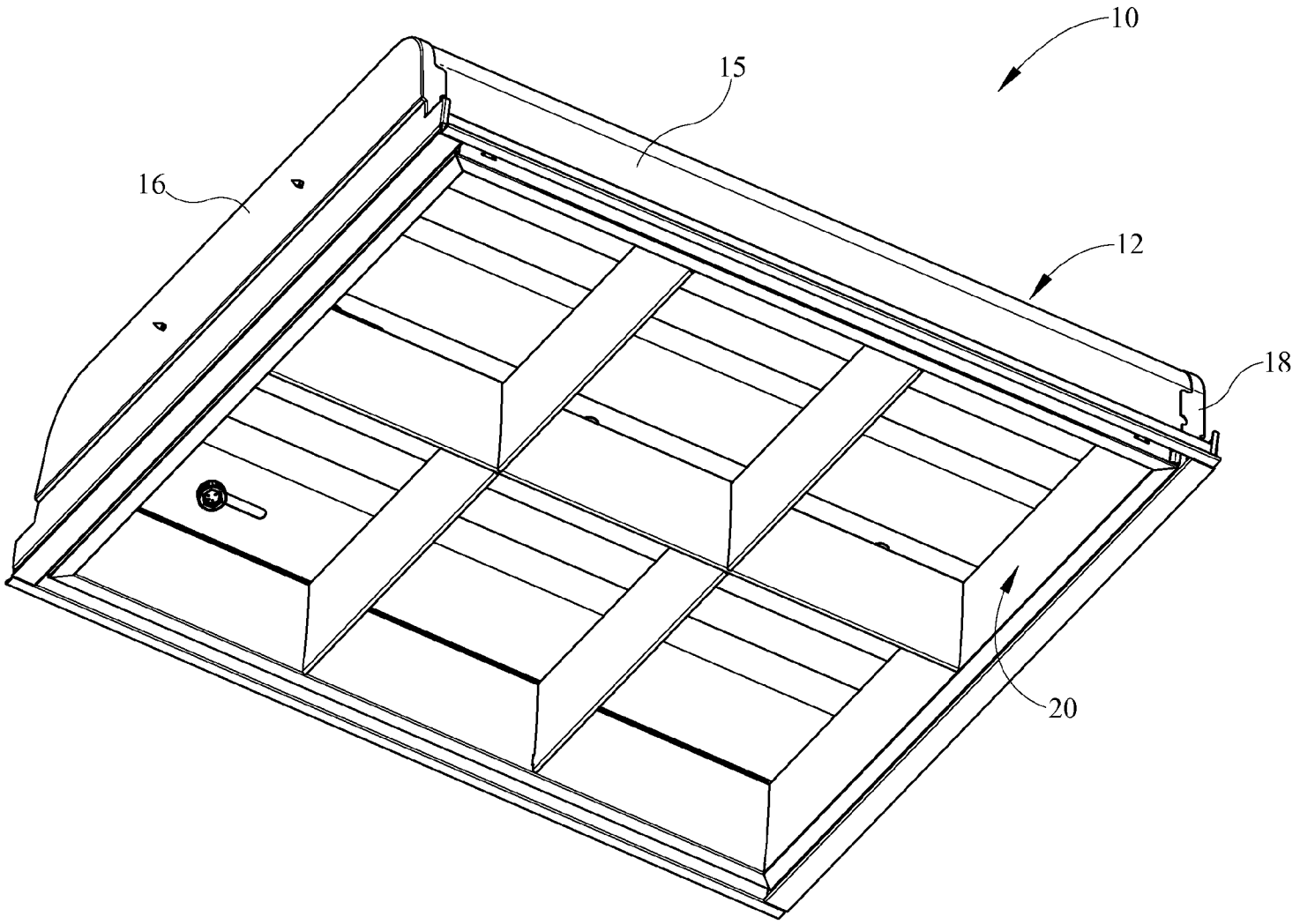
FIG. 1 is a lower perspective view of an exemplary retro-fit troffer luminaire.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

A retro-fit luminaire assembly is shown in the various FIGS. 1-10. The retro-fit luminaire utilizes an exiting housing with older optical and electrical components removed and replaces these with universal components which improve optical performance, reduce energy consumption and are easily installed. This system decreases the cost of renovating a building while providing illumination which looks and performs as a new fixture. The assembly also decreases labor costs associated with lighting in renovated buildings.

Referring now to FIG. 1, a lower perspective view of a retro-fit troffer luminaire assembly 10 is depicted. The retro-fit troffer luminaire 10 includes a housing 12 which may be pre-existing in a building or other structure being renovated. The original lighting components originally installed in the original luminaire 10 are removed and are replaced with these retro-fit components 11 (FIG. 3) described herein, so as to provide a retro-fit light assembly having a new look and optimal lighting characteristics without the costs of a completely new fixture and labor involved with such installation. This is advantageous for consumers. The use of the existing housing 12 in combination with the ease of installation of the components 11 can decrease the installation time for each retro-fit troffer luminaire 10 to about fifteen minutes or less. This is advantageous for consumers.

Figure 8:
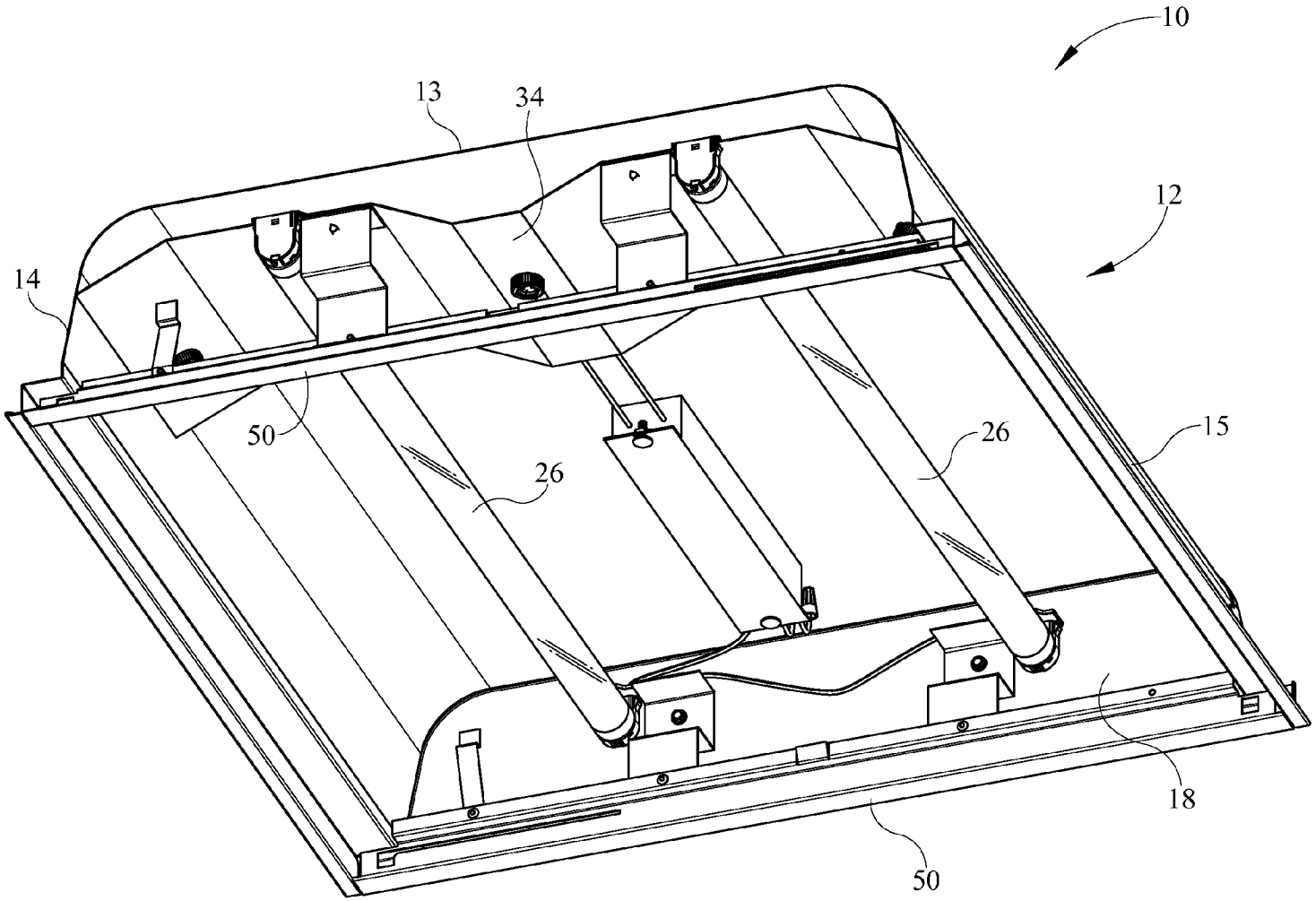
FIG. 8 is a lower perspective view of the retro-fit troffer luminaire in FIG. 7 with a portion of the powertray removed.
Figure 9:
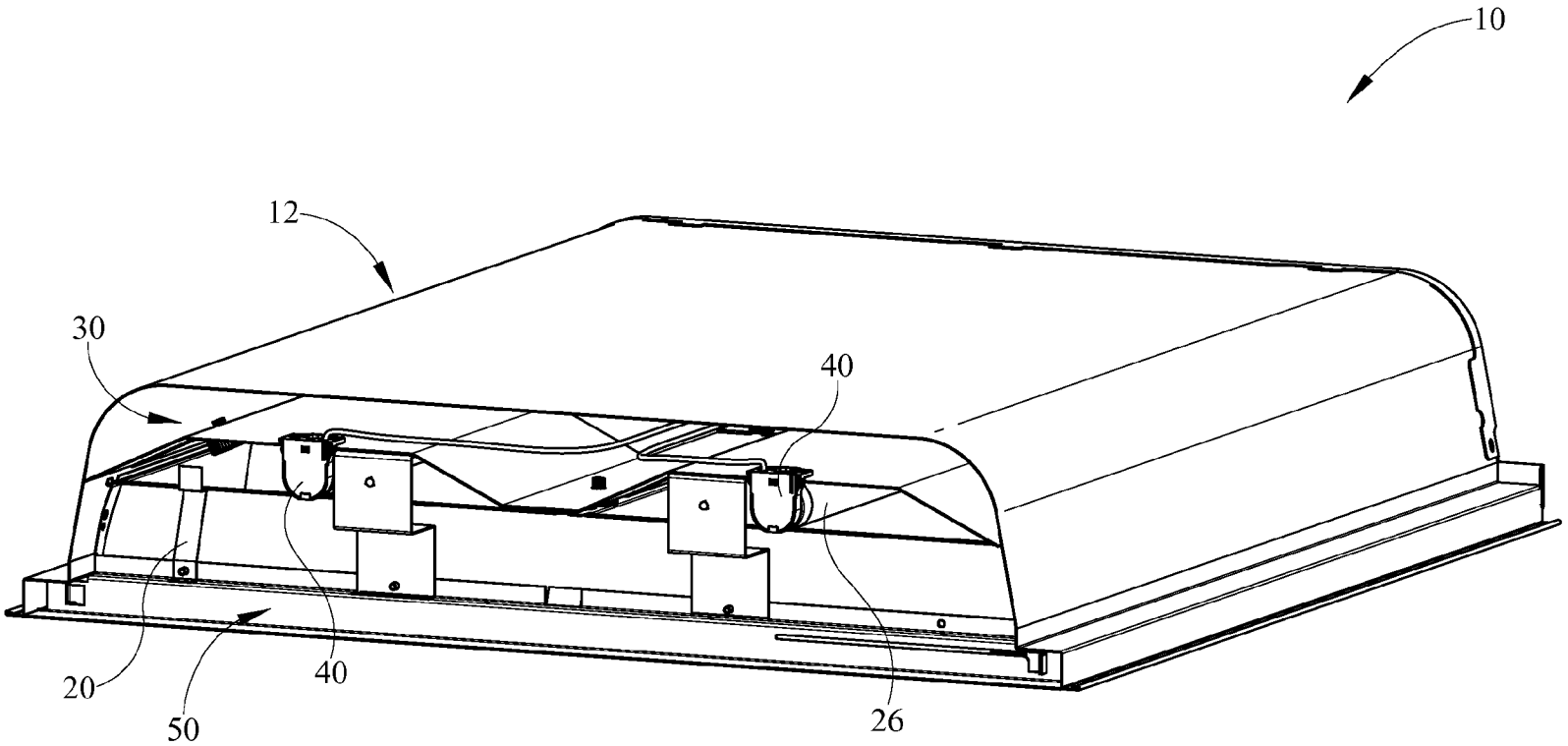
FIG. 9 is a detailed perspective view of the powertray retaining assembly engaging the powertray; and, FIG. 10 is a lower perspective view of the retro-fit troffer luminaire with the diffuser removed to clearly depict the internal components.

The housing 12 as shown in FIGS. 1, 8 and 9 has a body defined by a generally flat upper surface 13 and two depending sidewall surfaces 14, 15 which are adjoined to the upper surface 13 so that the housing 12 is generally parabolic in shape. Such construction is not required as other shapes may be utilized, and therefore the instant housing construction should not be considered limiting but merely exemplary. The housing 12 further comprises a first end cap 16 and a second end cap 18 which are positioned at ends of the housing 12 to generally close the housing structure. Each of the first and second end caps 16, 18 engage the end edges of the housing top wall 13 and sidewalls 14, 15. Thus, the end caps 16, 18 are shaped similarly to the end profile of the housing 12 in order to receive the ends of the body portion of the housing.

The housing 12 generally define a lower opening of the troffer luminaire 10 wherein a diffuser 20 is positioned. The term diffuser should be understood to mean any structure which varies the light output of the lamp within the luminaire 10. For instance, the diffuser 20 could be a louver arrangement, as depicted, or it could be a lens, shielding or any other structure as defined. Thus, the exemplary louver shown should not be considered to limit the term diffuser. The diffuser 20 may have a reflective surface which is specular or diffuse and may be formed of metal, polycarbonate or other materials which may or may not be coated. The diffuser could also be a door frame with a lens. The diffuser 20 may be defined by a new component which is retro-fit into the existing housing or may be an existing diffuser which is utilized after the internal optical and power components are installed into the housing 12. The exemplary louver may be a multi-cell as described further, depending on the dimensions of the housing, with a reflective white outer coating on at least the visible surfaces thereof.

Installing the retro-fit component 11 (FIG. 3) is less costly than complete replacement with a new lighting fixture. Since the existing housing 12 is utilized, the internal optical and power components of the pre-existing luminaire need only be removed. Subsequently, the new components are installed into the existing housing which therefore does not require access above the ceiling where the luminaire 10 is positioned. Thus, since the housing is not replaced and since existing power supply wiring is used to power the lighting components, less labor is utilized in installing the retro-fit luminaire 10. One limiting factor of the retro-fit factor component is the size of the housing 12. As described further herein, the retro-fit components compensate for varying dimension of the original housing thereby providing an assembly usable with various housings.

Figure 2:
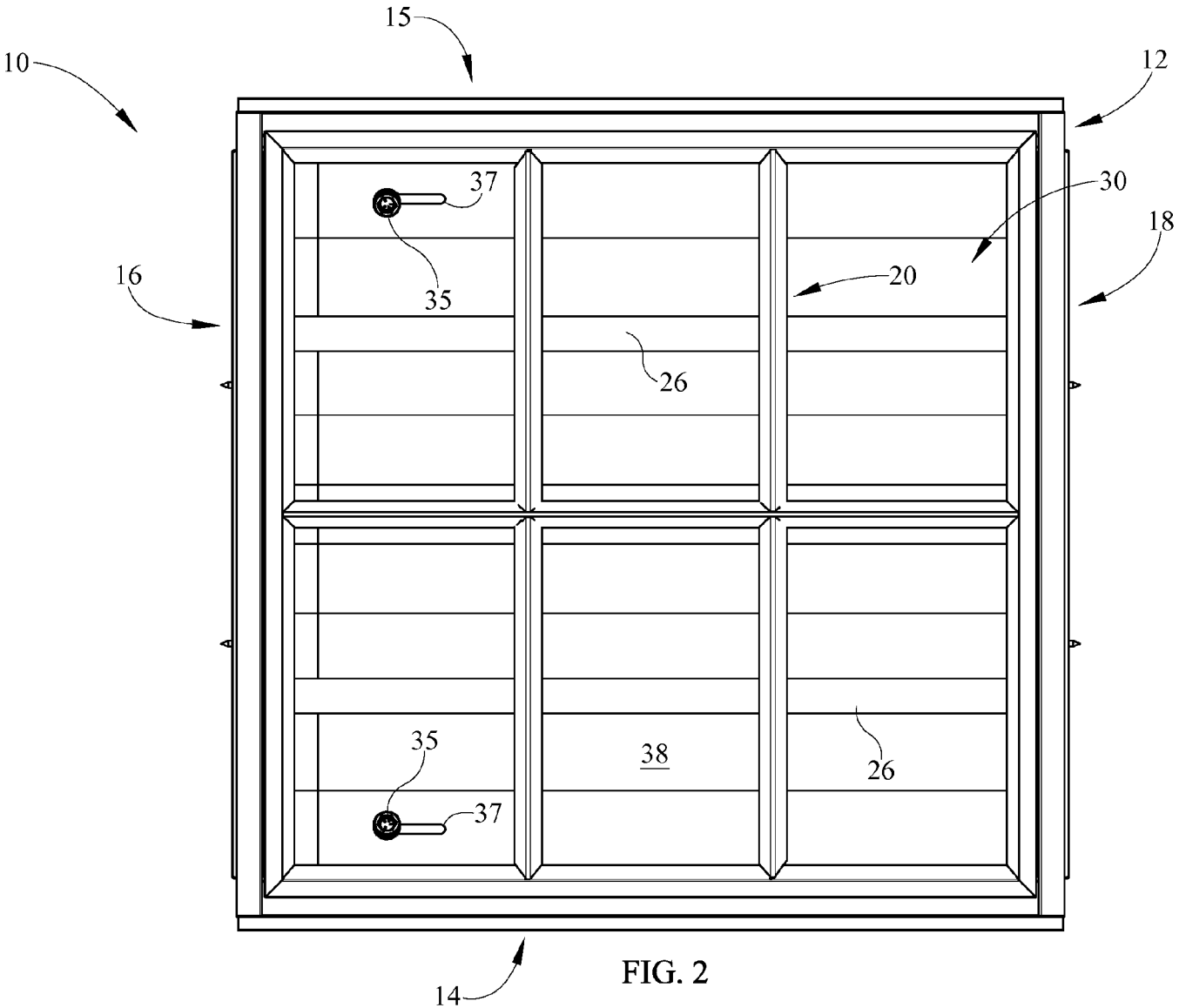
FIG. 2 is a bottom view of the retro-fit troffer luminaire of FIG. 1.

Referring now to FIG. 2, a bottom view of the retro-fit troffer luminaire 10 is depicted. The diffuser 20 is fitted within the opening defined by the housing 12 and end caps 16, 18. Within the housing 12 above the diffuser 20 is a powertray 30. Positioned between the powertray 30 and the diffuser 20 is at least one lamp 26. The exemplary lamp may be a fluorescent lamp although other lamp types may be utilized. For example, the fluorescent lamp may be a T5, a T8, a TT5 or a T5HO. The lamp 26 may be limited by the size of the housing such as 2×2, 2×4 or 1×4, for example, and the amount of light output desired for the area be illuminated. Additionally, other light sources and types may be utilized in order to provide a desirable light output and therefore this description should not be considered limiting.

As described above, one limiting factor for use of the retro-fit components is the size of housing 12. The bottom view of FIG. 2 depicts at least one fastener 35 which allows slidable adjustment of at least one dimension of the powertray 30. A slot 37 allows adjustment in the direction of the slot (right and left in figure) to lengthen or shorter the powertray 30. As discussed previously, an opening in a suspended ceiling grid typically has a dimension which is less than a corresponding dimension between lamp sockets. For example, for luminaires having 48" (inches) lamps, a corresponding opening dimension of a suspended ceiling is typically 47" (inches). The powertray 30 therefore must be able to fit within the opening defined by the suspended ceiling grid and housing opening, but also expand to a size capable of use with the appropriate lamp length. The slot 37, in combination with the first and second portions of the powertray 30 allow the lengthening or shortening of at least one powertray dimension so that the powertray 30 can fit through the ceiling grid opening as well as position lamp sockets 40 at an appropriate distance for use with lamps.

Figure 3:
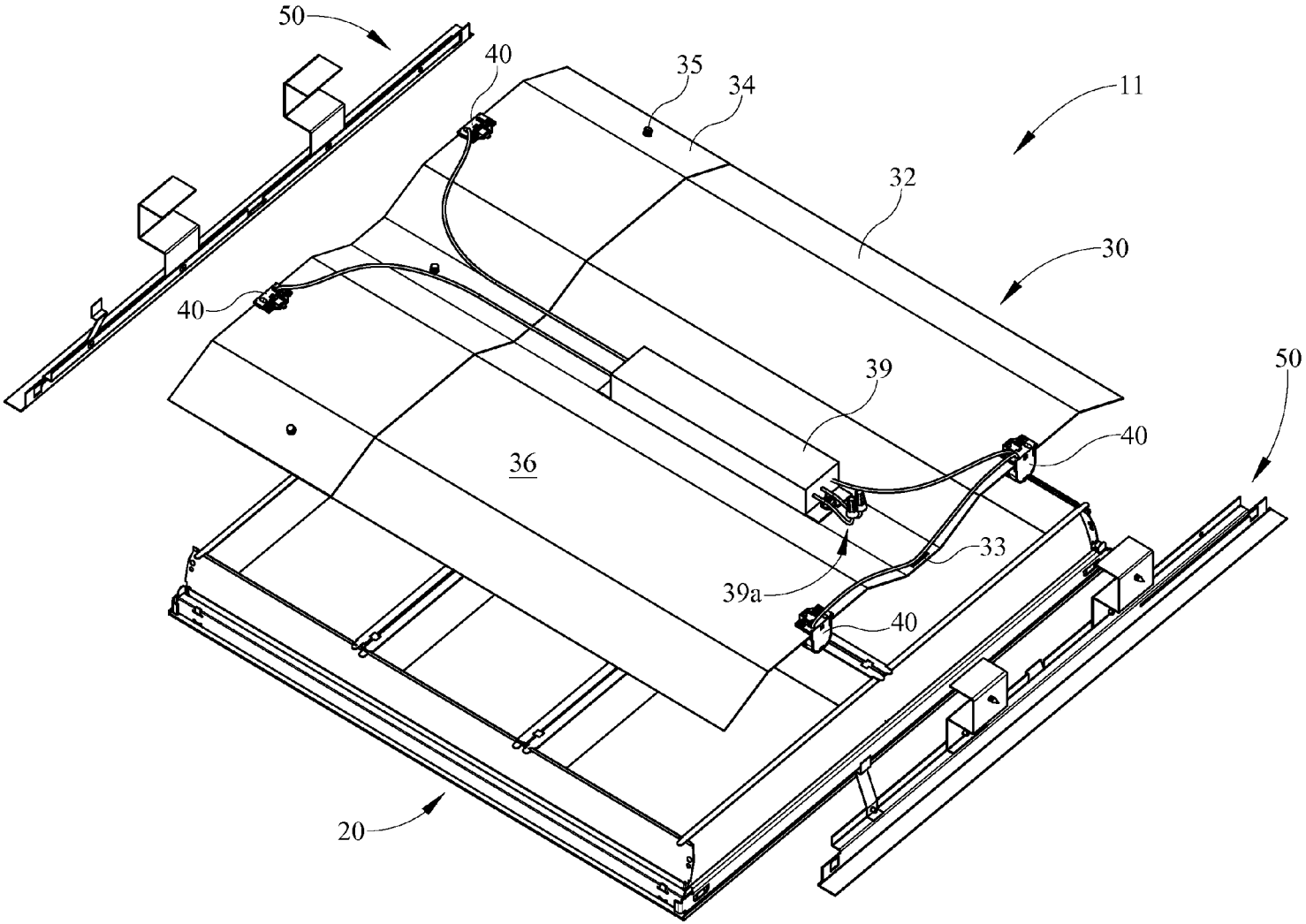
FIG. 3 is an upper exploded perspective view of the internal components of the retro-fit troffer luminaire of FIG. 1.

Referring now to FIG. 3, an exploded perspective view of the optical and power retro-fit components 11 is depicted with the housing 12 removed. The powertray 30 includes a first portion 32 and a second slidable portion 34. The second portion 34 is extendable or telescoping in order to adjust the length dimension of the powertray 30 for various sizes of pre-existing housings 12. As described previously, the powertray 30 allows for positioning through the smaller housing and grid ceiling opening, while allowing expansion to accommodate proper spacing of the lamp sockets 40. The powertray 30 includes an upper surface 36 and a lower surface 38 (FIG. 2). The lower surface 38 of the powertray may be a reflective material, such as a ninety five percent reflective white baked polyester enamel over a dye formed cold rolled steel. It could also be alternative reflective finishes or materials. The steel or other metallic material may have a preventative rust undercoating as well.

Also positioned on the upper surface of the powertray 30 is a power supply, transformer or ballast 38. The power supply receives an input power connection from existing wiring in the housing 12 (FIG. 1) and is in electrical communication with a plurality of lamp sockets 40. According to the exemplary embodiment, the ballast 39 has input wiring 39*a* for receiving power to energize the lighting components as well as wiring 39*b* extending from the ballast 39 to a plurality of lamp sockets 40. These sockets 40 connect to the at least one lamp 26. According to the exemplary embodiment, four lamp sockets 40 are utilized to power two lamps 26. The powertray 30 may be prewired to further aid in fast installation and therefore reduced installation costs.

Adjacent the powertray 30 at housing ends corresponding to end caps 16, 18 locations are first and second power tray retaining assemblies 50. The powertray retaining assemblies 50 each connect to the end caps 16, 18 (FIG. 1) and support the powertray 30 at each end thereof. The powertray retaining assemblies 50 are fastened against end caps 16, 18 thus limiting the powertray 30 length to the corresponding length between the end caps 16, 18 or the corresponding length of the body of the housing 12 or ceiling grid opening.

Figure 4:
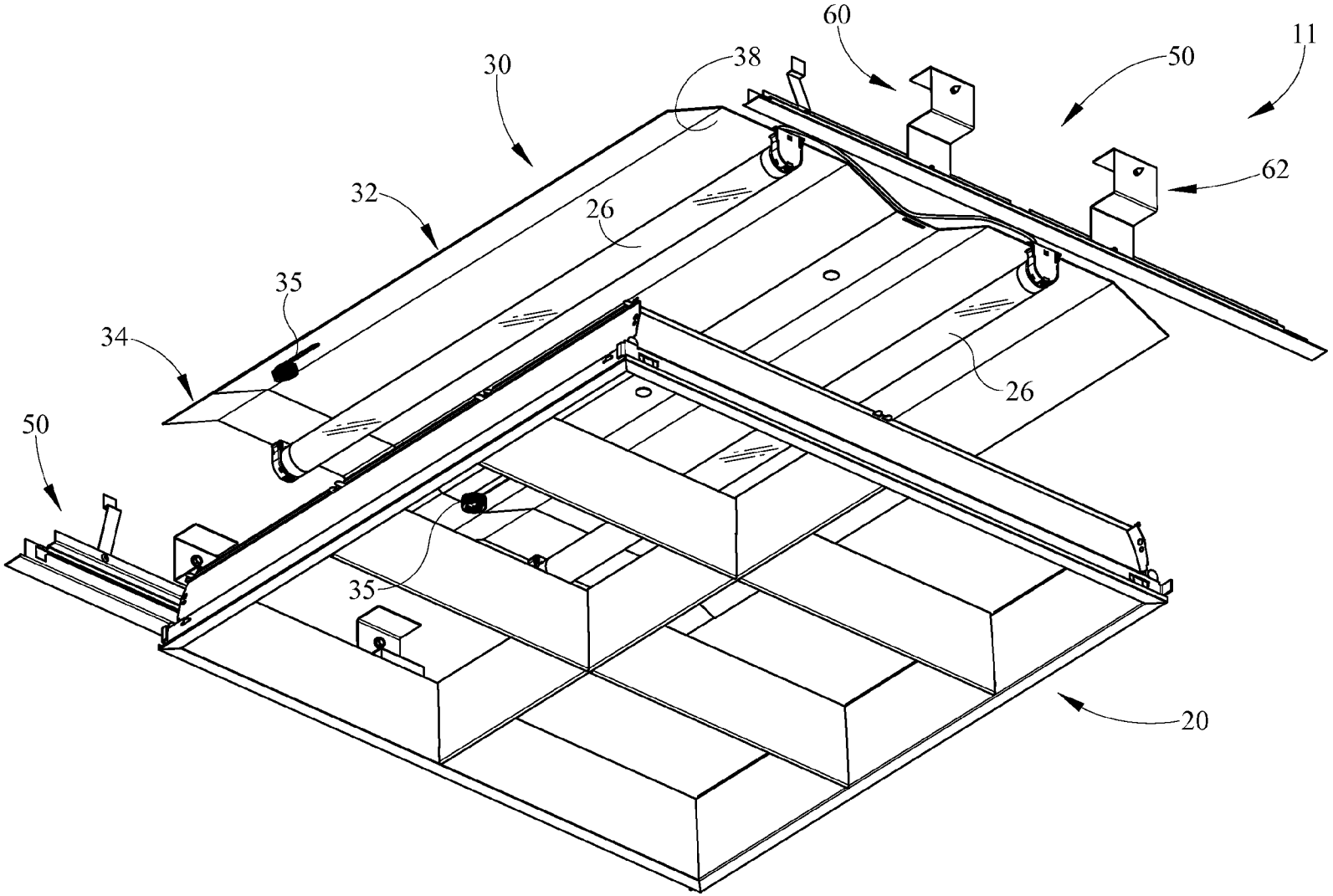
FIG. 4 is a lower exploded perspective view of the internal components of the retro-fit troffer luminaire.

Referring now to FIG. 4, a lower perspective view of the retro-fit components 11 including the powertray 30, the retaining assemblies 50 and the diffuser 20 are depicted. The lower surface 38 of the powertray 30 is formed of a reflective material to increase optical performance of the retro-fit luminaire 10. The powertray 30 has a gull-wing or bat-wing shape to receive first and second lamps 26. Alternatively, other reflector shapes could be utilized. The powertray retaining assemblies 50 each have first and second arms 60, 62 supporting each end of the powertray 30.

From the lower view of the powertray 30, the fasteners 35 are depicted. These fasteners 35, according to the exemplary embodiment, are thumbscrews which allow tightening of the first portion 32 against the second portion 34. The fasteners 35 are also coated with a reflective material to enhance optical characteristics of the powertray 30 and inhibit creation of dark spots within the luminaire. The powertray 30 is extended to a size which allows the powertray 30 to be supported by each of the retaining assemblies. Subsequently, the fasteners 35 are tightened.

Figure 5:
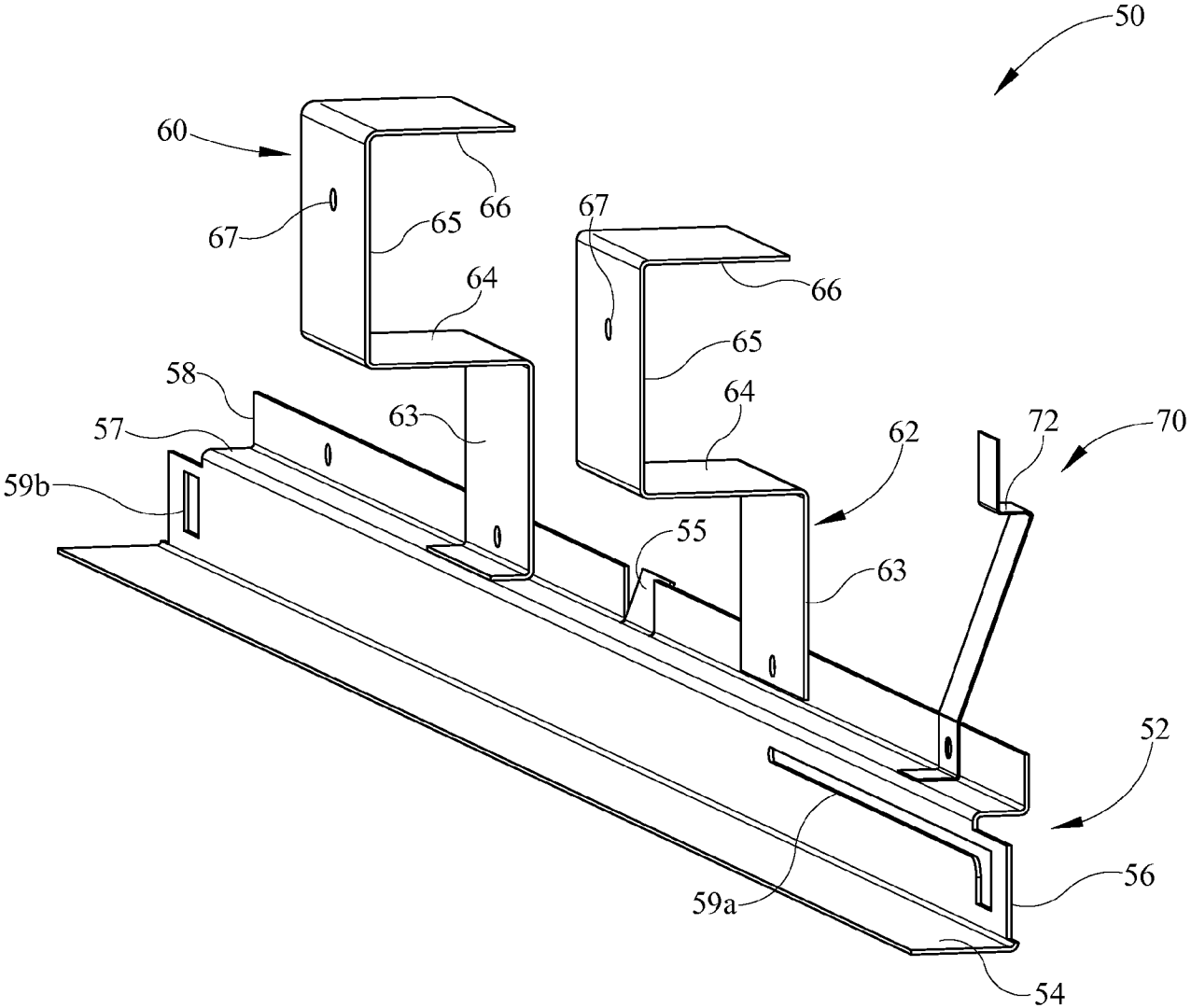
FIG. 5 is a perspective view of a powertray retaining assembly.

Referring now to FIG. 5, a powertray retaining assembly 50 is depicted in perspective view. The powertray retaining assembly 50 includes a base portion 52 which is defined by, for example, an extruded shape or structure. The base portion 52 has a first generally horizontal leg 54 and a first vertical leg 56 connected thereto. This defines a generally right angled structure. At the upper portion of second leg 56 a second right angled structure is defined by a second horizontal leg 57 and an upper second vertical leg 58.

Extending from the base portion 52 are the first and second powertray support arms 60, 62. Each of the first and second support arms 60, 62 has a lower vertical structure 63, a lower horizontal structure 64 extending in an outward direction relative to the housing 12, a second vertical structure 65 and a second horizontal structure 66 extending inwardly relative to the housing 12. Each of the second vertical structures includes a fastening aperture 67. These apertures 67 are utilized in combination with a fastener to attach the powertray retaining assembly 50 to the end caps 16, 18. The upper horizontal structures 66 provide support for the powertray 30 when the luminaire 10 is constructed.

The powertray assembly further comprises a spring 70 which provides a seat for an upper lip area of a diffuser 20. The spring shoulder 72 receives an upper lip portion of the diffuser 20 when the diffuser is positioned in the fixture 10. The spring 70 may be pulled away from the diffuser so that the shoulder 72 no longer supports the upper lip portion of the diffuser 20 and allows for the diffuser 20 to drop downwardly.

The housing 12 (FIG. 1) has a height which limits the height of the retaining assembly 50. The height of the retaining assembly 50 should be less than or nearly equal to the height of the housing to inhibit any portion of the components from extending below the ceiling level. The height of the exemplary assembly 50 requires a housing to have a height of at least about 4⅜ inches. However, this dimensional description is merely exemplary and should not be considered limiting.

The powertray retaining assembly 50 also includes a tab 55 which extends at an angle from the upper vertical leg 58. The tab 55 is utilized to hang the powertray 30 therefrom so that the wiring connections may be made between the power input wire and that transformer or ballast 39. As shown in FIG. 3, the powertray 30 includes a slot 33 which receives the tab 55. When the tab 55 is positioned through the slot 33, the powertray 33 is fully supported in a hanging position from the assembly 50. In this position, the installer can work "hands-free" meaning that the installer does not have to hold the powertray 30 with one or both hands. Instead, the installer can focus on the wiring installation with both hands.

The base portion 52 has a slot 59*a* at one end and an aperture 59*b* at the other end. The slot 59*a* is utilized for allowing pivoting and installation of the diffuser 20. The aperture 59*b* receives an opposite end of the diffuser 20 when the diffuser is rotated upwardly and is seated on spring 70.

Figure 6:
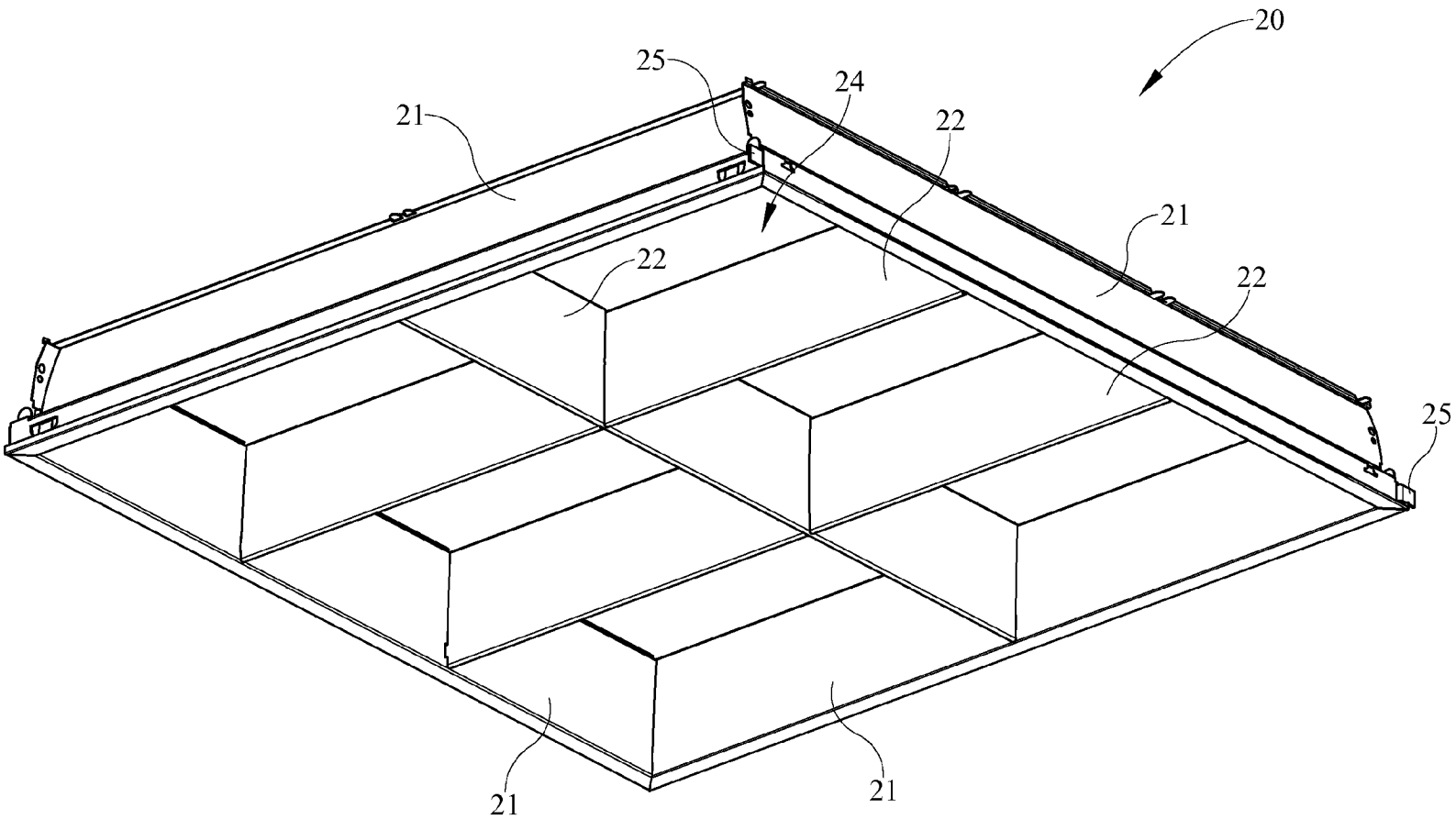
FIG. 6 is a lower perspective view of a diffuser.

Referring now to FIG. 6, a diffuser 20 is depicted in a lower perspective view. In the embodiment depicted, the diffuser 20 is a louver which is generally square in shape. The shape of the diffuser 20 is limited by the shape of the housing opening. The diffuser 20 has a plurality of louver blades 22 to define cells 23 in the structure. The diffuser 20 includes an outer frame defined by a plurality of frame structures 21. Within the frame are a plurality of louver blades 22. The diffuser 25 also includes hinge pins 25 which are received by the base portions 52 of the powertray support assembly 50, specifically slot and aperture 59*a*, 59*b*. As previously described, the diffuser 20 may alternatively be embodied by a lens or other structure. Additionally, the structures providing pivoting connection between the diffuser 20 and the powertray support assembly 50 may differ but should be considered within the scope of the present embodiment as various designs may be utilized to ease installation and maintenance.

Figure 7:
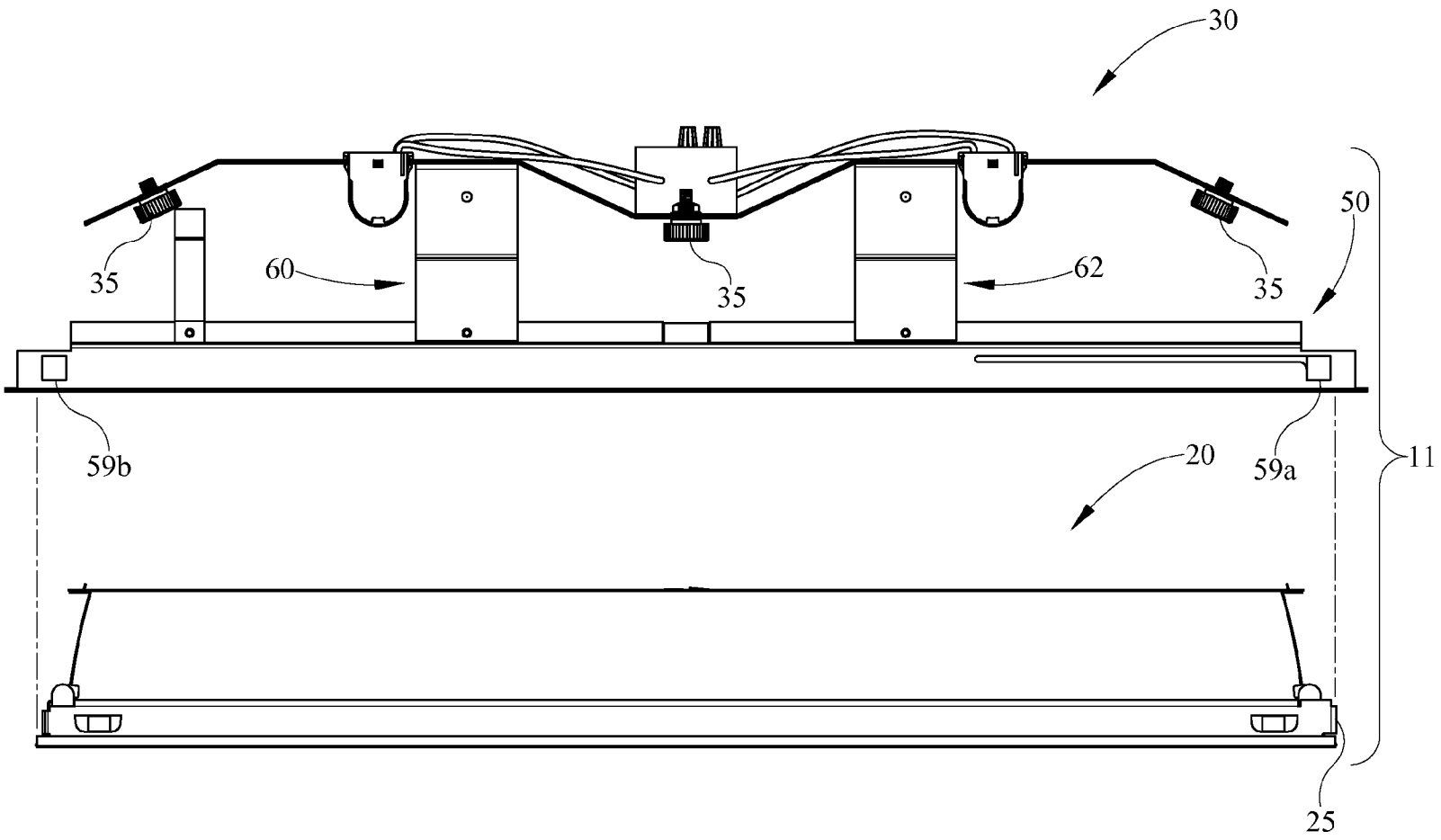
FIG. 7 is an exploded side view of the retro-fit components.

Referring now to FIG. 7, an exploded side view of the retro-fit components 11 is depicted. The powertray 30 is shown being supported by the powertray retaining assembly 50 and specifically the support arms 60, 62 thereof. The diffuser 20 is shown beneath the powertray retaining assembly 50 and may be moved upwardly to engage the powertray retaining assembly and may be seated within pivot apertures 59. The diffuser 20 includes projections 26 which are received by the pivot apertures 59 to retain the diffuser 20 therein.

Additionally, FIG. 7 shows how the second horizontal structures 66 of the support arms 60, 62 support the powertray 50 from the below. Thus, the retaining assembly 50 is at least partially supported by a suspended ceiling through attachment to the end caps 16, 18 (FIG. 2). The assembly 50 can therefore support the powertray 30 as well.

Referring now to FIGS. 8 and 9, the wiring connections may be seen within the retro-fit luminaires. With the powertray 30 partially removed in FIG. 9, the ballast 39 is shown floating beneath the housing top wall 13. The ballast 39, as previously described, is connected to the powertray portion which is removed. Extending from the ballast 39 are wiring elements extending to the sockets 40. The first and second lamps 26 extend between pairs of sockets 40 providing the electrical components for the retro-fit luminaire 10. Power extends into the housing 10 from existing wiring (not shown) and supplies the ballast 39 with the requisite voltage and current needed to power the system. The ballast 39 may be a line voltage or a variable input voltage ballast depending on the types of lamps utilized in the system.

Figure 10:
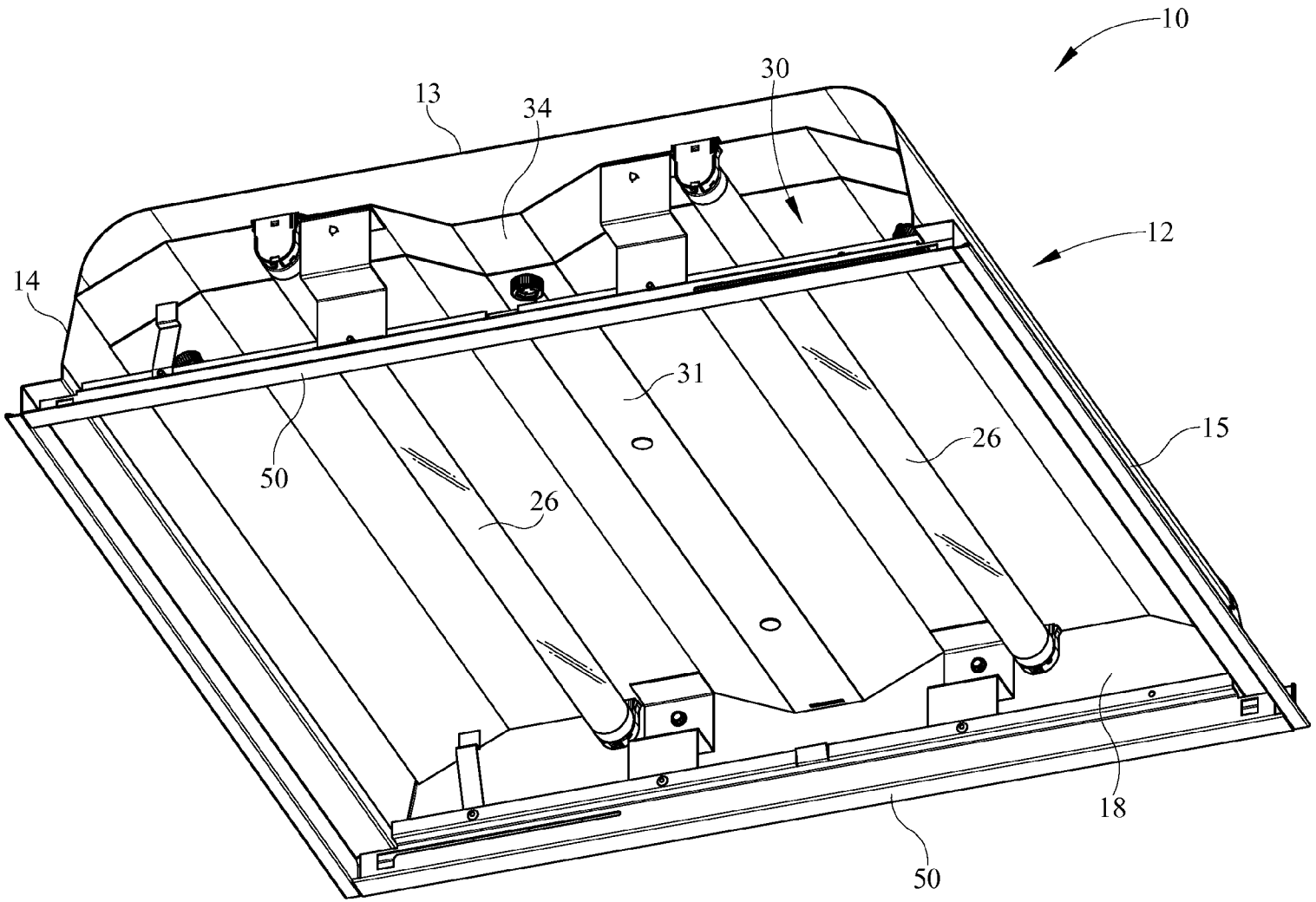

Referring now to FIG. 10, a lower perspective view of the retro-fit luminaire 10 is depicted. The retro-fit components 11 (FIG. 7) are disposed within the pre-existing housing 12. The lower opening defined by the housing 12 and the powertray retaining assemblies 50 allow for positioning of a diffuser (not shown) beneath the lamps 26 and the powertray 30.

For installation, the original electrical and optical components are removed from the housing 12 and the powertray retaining assemblies 50 are fastened into the end caps 16, 18 through the support arms 60, 62. The powertray 30 is supported on the powertray retaining assembly 50 by connection of slot 33 with tab 55. Next, the input power wire is connected to the ballast or transformer 39. With the retaining assemblies 50 positioned in the housing 12, the powertray 30, with the sockets 40 and wiring connections 39*b* complete, is inserted into the housing 12. In order to accomplish this, the fasteners 35 are loosened and the powertray second portion 32 is shortened to a length which is less than the distance between the support arms 60, 62. One end of the powertray 30 lifted upwardly above a first powertray retaining assembly 50, and the second end of the powertray is lifted above the second powertray retaining assembly 50 and above the second horizontal support arms 56 (FIG. 5). Once the powertray 30 is entirely positioned in an elevation above the retaining assemblies 50, the second portion 32 is slidably extended or telescoped outwardly to a distance greater than the inner distance between the second, upper support arms or fingers 66 on each side of the luminaire 10. Thus, the powertray is supported by the retaining assemblies 50 within the housing. Next, the lamps 26 may be connected to the sockets 40. Finally, the diffuser 20 is lifted upwardly into the opening defined by the housing 12 and the retaining assemblies 50. The diffuser 20 may be pivotally connected provided for easier handling by a single installer, as previously described.

The foregoing description of several embodiments of the invention has been presented for purposes of illustration. It is not intended to be exhaustive or to limit the invention to the precise steps and/or forms disclosed, and obviously many modifications and variations are possible in light of the above teaching. It is intended that the scope of the invention and all equivalents be defined by the claims appended hereto.

The invention claimed is:

1. A method of retro-fitting an existing luminaire housing comprising the steps of:

removing lighting components from said existing housing;

fastening a first powertray retaining assembly to an end cap of said existing housing;

fastening a second powertray retaining assembly to a second end cap of said existing housing, wherein said fastened second powertray retaining assembly is substantially parallel to the fastened first powertray retainer assembly, thereby defining a distance between said powertray retaining assemblies along a line substantially perpendicular to each of said powertray retaining assemblies;

telescoping a powertray to a size allowing said powertray to be moved through an opening in said existing housing;

inserting said powertray through said opening in said existing housing and retaining said powertray on one of said first and second retaining assemblies;

telescoping, in a direction substantially parallel to said line, said powertray to engage the other of said first and second retaining assemblies;

positioning a diffuser in said luminaire housing; and, wherein the powertray comprises a first portion and a second portion, and each of said telescoping steps comprises sliding the first portion against the second portion.

2. The method of claim 1 further comprising connecting a power supply wire to a ballast.

3. The method of claim 1 wherein the first portion to be engaged with the first retaining assembly and the second portion to be engaged with the second retaining assembly; the method further comprising tightening of at least one fastener to tighten the first portion against the second portion once said powertray is engaging said first and second retaining assemblies.

4. The method of claim 1 further comprising installing a lamp in lamp sockets on said powertray.

5. A method of retro-fitting an existing luminaire housing, comprising the steps of:

removing lighting components from an existing housing;

connecting a first powertray retaining assembly to said existing housing;

connecting a second powertray retaining assembly to said existing housing, opposite said first powertray retaining assembly wherein said connected second powertray retaining assembly is substantially parallel to the connected first powertray retainer assembly, thereby defining a distance between said powertray retaining assemblies along a line substantially perpendicular to each of said powertray retaining assemblies;

inserting a powertray into said existing housing, said powertray having an adjustable length;

extending the length of said powertray, in a direction substantially parallel to said line, to a length greater than a distance between support fingers of said first and second powertray retaining assemblies; and, mounting a diffuser in said luminaire housing.

6. The method of claim 5 wherein said powertray comprises a first portion and a second portion, the first portion to be connected to the first retaining assembly and the second portion to be connected to the second retaining assembly; the method, further comprising tightening a fastener to tighten the first portion against the second portion and thereby maintain said powertray in an extended position.

7. The method of claim 5, further comprising engaging said diffuser with a spring located on said first and second powertray retaining assemblies.

8. The method of claim 5, further comprising pivoting said diffuser from a first position to a second position.

9. A method of installing retro-fit components in a pre-existing housing having a directional axis defined by the longitudinal direction of lamps to be installed in the housing, the method comprising:

positioning a powertray within said pre-existing housing;

expanding, in a direction substantially parallel to the directional axis, said powertray within said pre-existing housing from a first length to a second length; and, positioning a diffuser within said pre-existing housing.

10. The method of claim 9, further comprising the step of hanging said powertray from a powertray support assembly and connecting a power supply wire to one of a ballast or transformer.

* * * * *